US012781973B2

(12) United States Patent
Athani et al.

(10) Patent No.: US 12,781,973 B2
(45) Date of Patent: Nov. 3, 2026

(54) VENTILATION CONTROL IN DOMESTIC APPLIANCE

(71) Applicant: WHIRLPOOL CORPORATION, Benton Harbor, MI (US)

(72) Inventors: Murgyappa Athani, Maharashtra (IN); Lingaraj Bandiwad, Haveri (IN); Omkar Bharat Jadhav, Pune (IN); Ashish S Kadam, Pune (IN); Ramesh Khot, Nipani (IN); Wojciech Pawłowski, Wroclaw (PL)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 523 days.

(21) Appl. No.: 18/468,864

(22) Filed: Sep. 18, 2023

(65) Prior Publication Data

US 2025/0093050 A1 Mar. 20, 2025

(51) Int. Cl.

| | |
|---|---|
| ***F24C 15/32*** | (2006.01) |
| ***F24C 7/00*** | (2006.01) |
| ***F24C 7/02*** | (2006.01) |
| ***F24C 15/00*** | (2006.01) |

(52) U.S. Cl.

CPC ..... *F24C 15/32* (2013.01); *F24C 7/006* (2013.01); *F24C 7/02* (2013.01); *F24C 15/003* (2013.01)

(58) Field of Classification Search

CPC ..... F24C 15/003; F24C 15/32; F24C 7/006; F24C 7/02

See application file for complete search history.

(56) References Cited

U.S. PATENT DOCUMENTS

| | | | | |
|---|---|---|---|---|
| 1,627,961 | A * | 5/1927 | Farley | F16L 5/00 126/317 |
| 4,321,726 | A * | 3/1982 | Rogers, Jr. | F16L 5/00 285/413 |
| 4,601,279 | A | 7/1986 | Guerin | |
| 7,856,875 | B2 | 12/2010 | Jeon et al. | |
| 8,151,821 | B2 * | 4/2012 | Ball | E04G 15/061 137/359 |
| 11,525,582 | B2 | 12/2022 | Lee et al. | |

FOREIGN PATENT DOCUMENTS

| | | | | |
|---|---|---|---|---|
| CN | 114587139 | B | 11/2022 | |
| DE | 29923420 | U1 * | 10/2000 | A21B 3/04 |
| JP | 54102640 | A2 | 8/1979 | |
| WO | WO-2004111542 | A1 * | 12/2004 | H05B 6/642 |

* cited by examiner

*Primary Examiner* — Michael G Hoang
*Assistant Examiner* — Logan P Jones
(74) *Attorney, Agent, or Firm* — BROOKS KUSHMAN P.C.

(57) ABSTRACT

A cooking appliance includes a wall partitioning a compartment into first and second zones and a housing disposed in the compartment and extending through an opening in the wall such that a first portion of the housing is in the first zone and a second portion of the housing is in the second zone. A flange assembly circumscribes the housing and is disposed against the wall at the opening to inhibit air flow though the opening. The flange assembly has a first member and a second member slidably received in the first member.

19 Claims, 6 Drawing Sheets

VENTILATION CONTROL IN DOMESTIC APPLIANCE

TECHNICAL FIELD

Aspects of the disclosure relate to a cooking appliance having a ventilated zone and a non-ventilated zone.

BACKGROUND

A microwave oven is a type of cooking appliance having a magnetron that heats food with electromagnetic radiation. When food is exposed to this electromagnetic radiation, molecules within the food move and produce thermal energy in a process known as dielectric heating. A microwave oven may heat food more quickly than a conventional oven having a gas burner or electric heating element. Heat is generated by the magnetron and other components of the microwave oven. To cool these components, the oven draws in cool air and blows that air over the components. The oven may also blow air through the oven cavity to carry away heat and smells produced within the oven cavity.

SUMMARY

According to one embodiment, a cooking appliance includes a wall partitioning a compartment into first and second zones and a housing disposed in the compartment and extending through an opening in the wall such that a first portion of the housing is in the first zone and a second portion of the housing is in the second zone. A flange assembly circumscribes the housing and is disposed against the wall at the opening to inhibit air flow though the opening. The flange assembly has a first member and a second member slidably received in the first member.

According to another embodiment, a cooking appliance includes a cooking chamber and a machine compartment separate from the cooking chamber. A wall partitions the machine compartment into a ventilated zone and a non-ventilated zone, wherein the wall defines an opening. A housing is disposed in the machine compartment and extends through the opening such that a first portion of the housing is in the ventilated zone and a second portion of the housing is in the non-ventilated zone. A gap is defined between the housing and a periphery of the opening. A flange assembly circumscribes the housing and is disposed against the wall such that the gap is covered to inhibit airflow between the zones. The flange assembly has a flange member surrounding a portion of the housing and a cap member surrounding another portion of the housing.

According to yet another embodiment, a cooking appliance includes a front panel defining an opening into a cooking chamber. The appliance further includes a top panel and a machine compartment disposed above the cooking chamber and under the top panel. The machine compartment has a wall positioned reward of the front panel and extending between the top panel and a floor of the machine compartment. The machine compartment has a ventilated zone between the front panel and the wall and a non-ventilated zone rearward of the wall. A water-reservoir assembly is disposed in the machine compartment and includes a housing extending rearward from the front panel and through an opening defined in the wall such that the housing is partially disposed in both the ventilated and non-ventilated zones. The housing has a base and a cover. The base defines a flange configured to cover a gap defined between the base and a periphery of the opening. A cap member is disposed on the cover at the opening and has a planar portion extending between the top panel and the cover to inhibit air flow through the opening.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
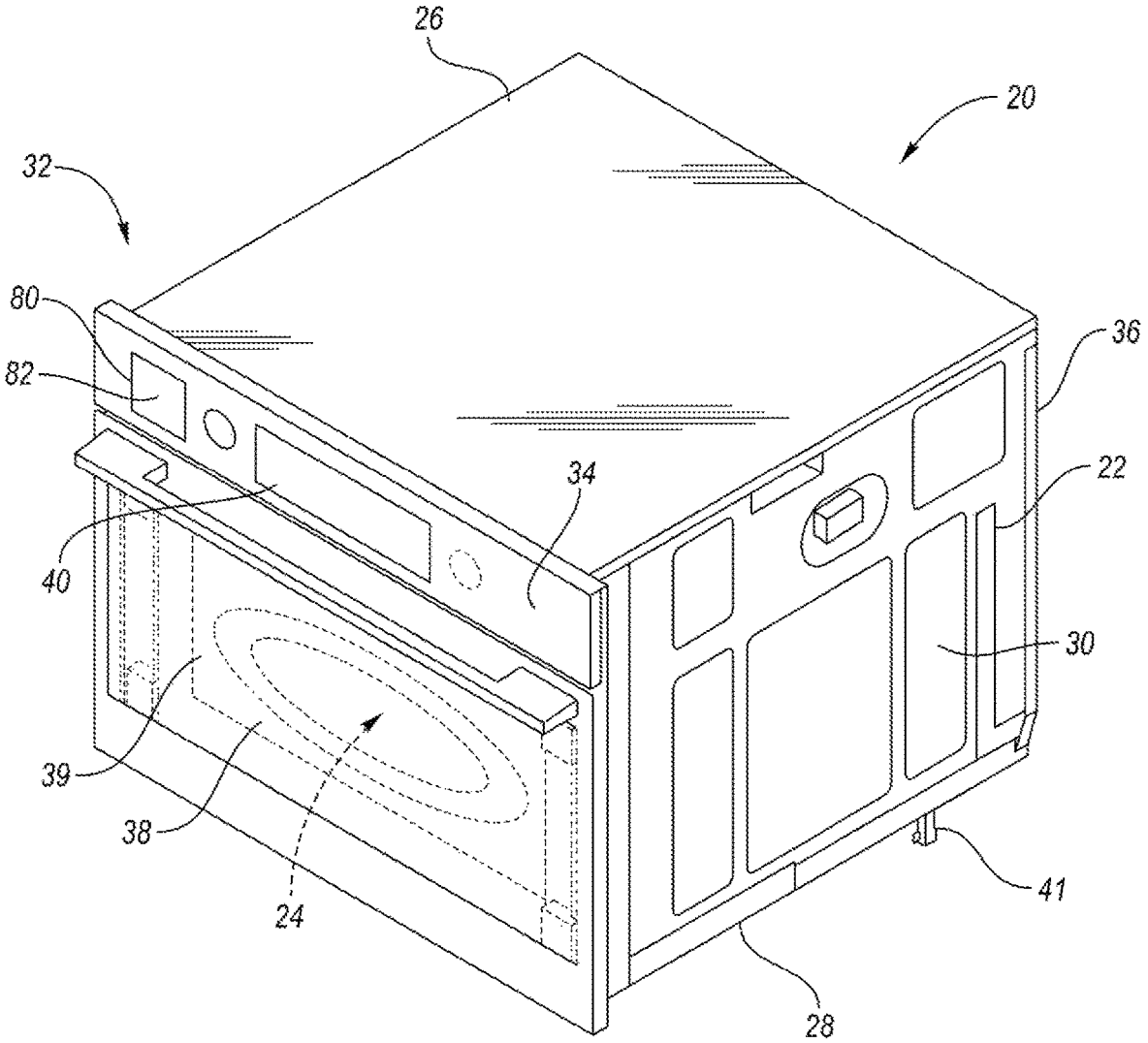
FIG. 1 is a front perspective view of an oven appliance.
Figure 2:
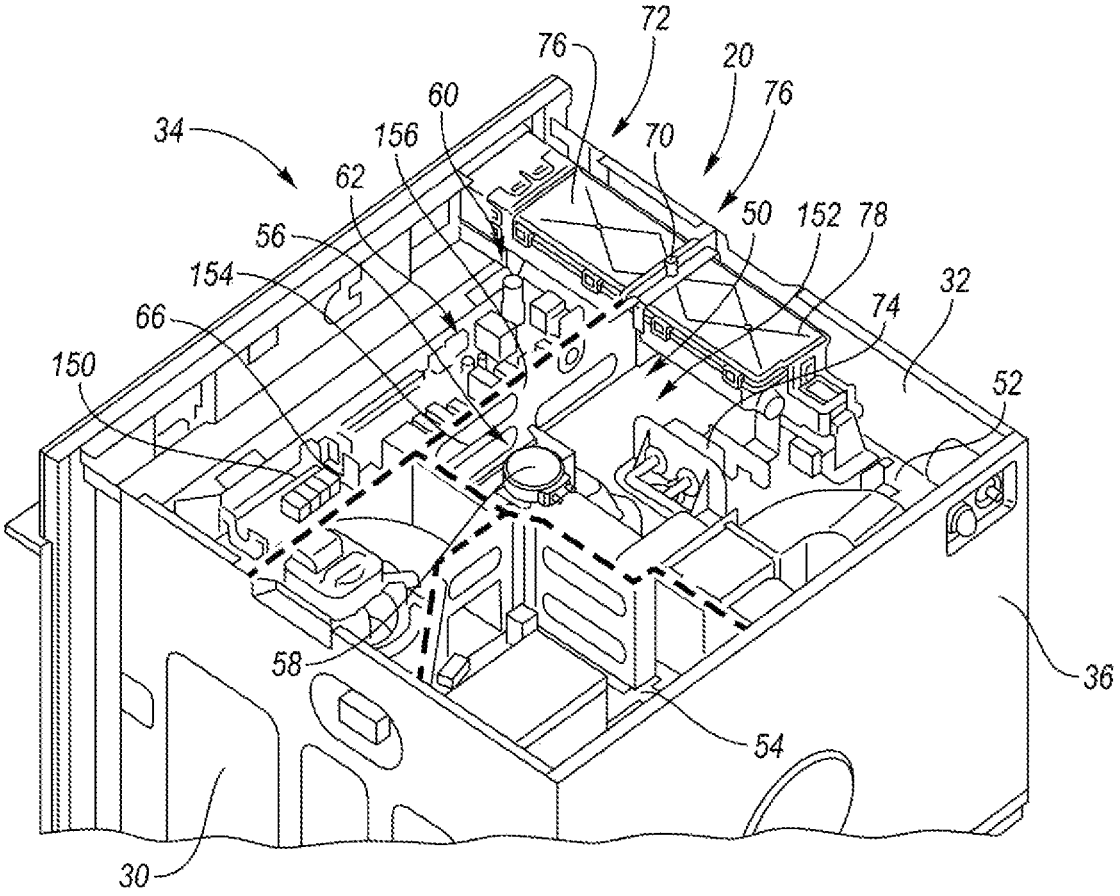
FIG. 2 is a rear perspective view of the oven appliance with the top panel removed to show the machine compartment.

Referring to FIGS. 1 and 2, an oven 20, e.g., a microwave oven, includes a cabinet 22 defining an internal cooking chamber 24 for cooking food. The cabinet may include a top 26, a bottom 28, sides 30, 32, a front 34, and a back 36, which may be formed of metal panels that are interconnected together to form the exterior of the cabinet 22. The microwave oven 20 includes a door 38 pivotally attached to the front 34 and configured to open and close the cooking chamber 24. The door 38 may pivot about a vertical axis located on either the left side or right side of the cooking chamber or may be pivotable about a horizontal axis (as shown), such as along the bottom front edge of the oven 20. The door 38 may include a window 39, e.g., glass or transparent plastic panel, allowing a user to monitor the food during cooking. The window 39 may be shielded by a metal mesh to prevent the passage of the radiation. Feet 41 may be provided on the bottom 28 of the oven 20. The feet 41 may include rubber or the like.

The oven 20 includes a user interface 40 that allows a user to operate the oven 20. The user interface 40 may be located on the front panel 34 near the top of the oven 20 above the cooking chamber 24. This upper placement is just an example, and the user interface 40 may be provided at any suitable location on the front 34 of the oven 20. For example, the user interface 40 may be located on the side of the front panel 34. The user interface 40 may include physical buttons, dials, a touchscreen, and/or the like.

A machine compartment 50 houses various electrical and hardware components of the oven 20. In the illustrated embodiment, the machine compartment 50 is located under the top panel 26 and above the cooking chamber 24. Alternative placements include on the sides of the cabinet 22 or located at the bottom of the cabinet 22. In the illustrated embodiment, the machine compartment 50 is defined depth-wise between the front panel 34 and the rear panel 36, width-wise between the side panels 30 and 32, and height-wise between the top panel 26 and an intermediate panel 52. The intermediate panel 52 may include a lower surface that defines the top of the cooking chamber 24 and may include an upper surface that defines a floor 54 of the machine compartment 50.

In the illustrated embodiment, the oven 20 has a microwave cooking cycle and includes a microwave system 56 that cooks food using microwave energy. The microwave system 56 includes, inter alia, a magnetron 58, a transformer 60, a capacitor 62, a power supply, and an electronics board 66. To perform a microwave cooking cycle, food is placed in the cooking chamber 24, the door 38 is closed, and the magnetron 58 is activated. During operation, microwave energy travels from the magnetron 58 through a waveguide and is distributed into the cooking chamber 24 via a mode stirrer. The microwave energy transfers to the food via dielectric heating. Once the food is heated, the magnetron 58 is deactivated, the door 38 is reopened, and the food is removed. The oven 20 may also include a door switch (not shown) that detects whether the door 38 is open or closed, such that the magnetron 58 is automatically deactivated should the door 38 be opened during a cooking cycle. The magnetron 58 may be driven by electrical components that provide a high-voltage source, such as the transformer 60 and capacitor 62 as shown (in other examples a switching power supply may be used). The electronics board 66 may control the operation of the other components of the oven 20.

The oven 20 may also have a steam cooking cycle and includes a steam system 70. The steam system 70 is configured to deliver steam to the cooking chamber 24. The steam system 70 includes a heating element (not shown) that heats water provided from a water reservoir 72. A pump system 74 is configured to draw water from the water reservoir 72 and deliver the water to the heating element. The heating element, such as an electric heating element boils the water received from the water reservoir 72 to produce steam. Ducts or passageways (not shown) convey the steam to the cooking chamber 24 to cook the food.

The water reservoir 72 may be part of a water-reservoir assembly 76 including a housing 78 that contains the water reservoir 72. The water reservoir 72 may be a tank or other receptacle received within the housing 78. The water reservoir 72 may be removable from the housing 78 allowing a user to add water as needed. For example, the water reservoir 72 may be slidably supported within the housing 78 via plain bearing surfaces or via tracks, bearings, sliders, or any other suitable guide member. The water reservoir 72 may be directly supported by the housing 78 or an associated carriage may slidably support the water reservoir 72 within the housing 78. The water reservoir 72 may slide in and out of the front panel 34 of the oven 20 between a pulled-out position in which the water reservoir 72 extends from the front panel 34 and a pushed-in position in which the water reservoir 72 is fully seated within the housing 78.

An opening 80 for the water reservoir 72 may be provided on the front panel 34 above the cooking chamber 24 and adjacent to the user interface 40. A door or cover 82 may be provided to conceal the water reservoir 72 when in the pushed-in position. The door 82 may be pivotably attached to the front face 34 or may be attached to the water reservoir 72 or other component associated with the water reservoir that slides therewith. The water reservoir 72 may be spring-loaded and include a latching system that allows a user to access the water reservoir 72. For example, a user may remove the water reservoir 72 by pushing on the cover 82 to release the latching system. The spring then partially ejects the water reservoir 72 from the front panel 34. The user may then grab the partially ejected water reservoir 72 and pull the water reservoir fully out. This is just an example and other mechanism may be used to remove the water reservoir 72.

The water reservoir 72 may be detachable from the oven 20 so that a user may carry the water reservoir 72 to a water source, e.g., a sink, for refilling. The water reservoir 72 may include a filling port and a cap that seals the port. The cap may be attached by threads, detents, click fit, or the like. In some embodiments, the cap may be slidably attached to the water reservoir 72 to cover and uncover the port.

Figure 3:
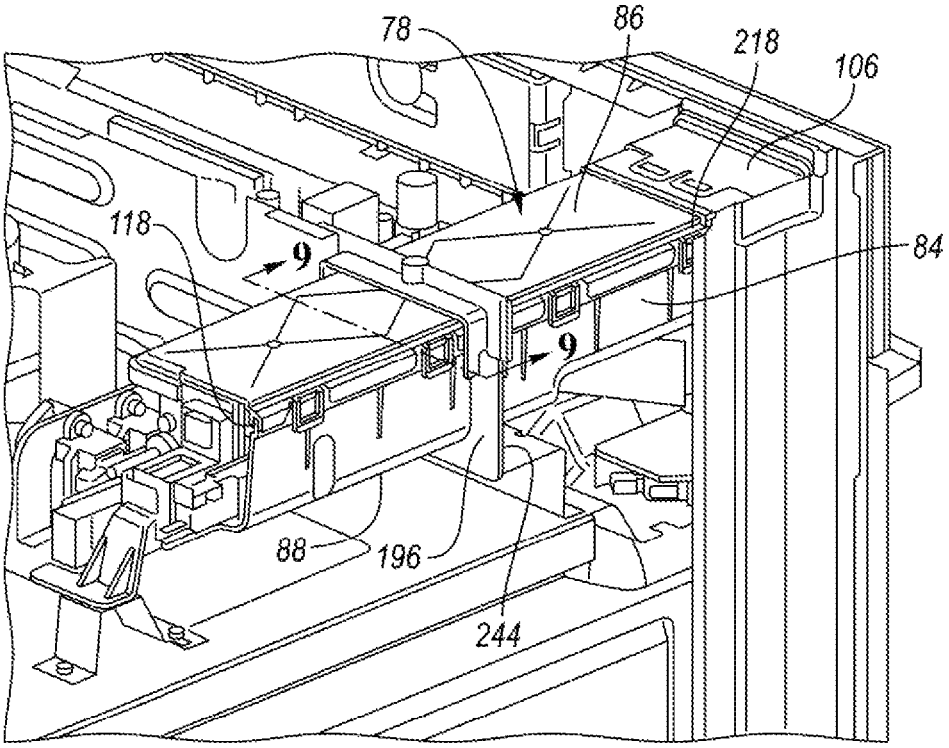
FIG. 3 is a perspective view of the machine compartment detailing a water-reservoir assembly.
Figure 4:
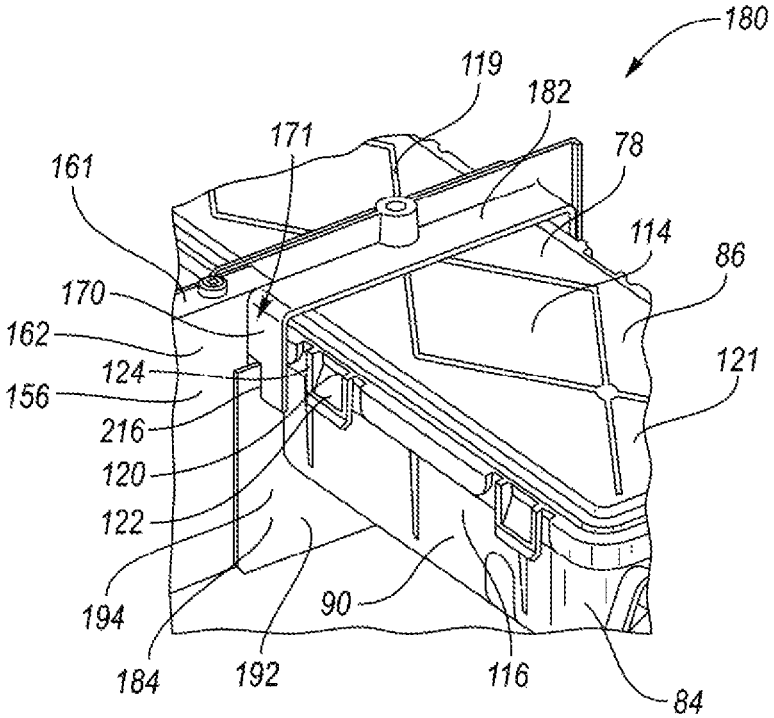
FIG. 4 is a partial perspective view of the water-reservoir assembly.
Figure 5:
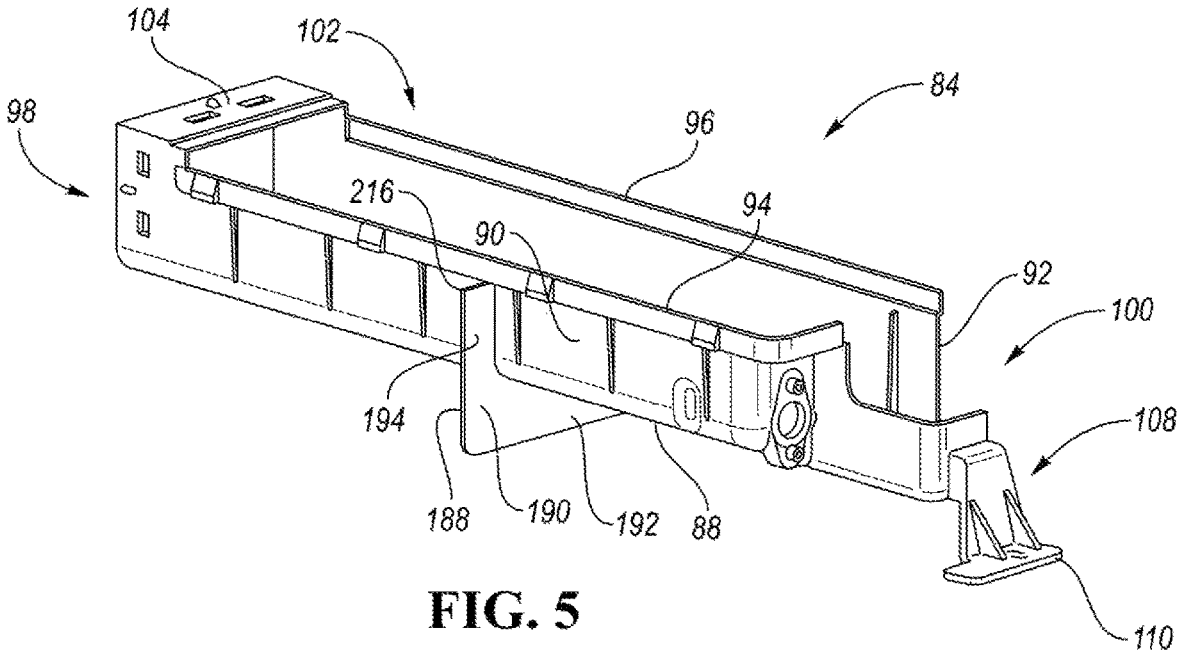
FIG. 5 is a perspective view of a base of a housing of the water-reservoir assembly.

Referring to FIGS. 3, 4, and 5, the housing 78 may be formed from multiple pieces. The pieces may be injection-molded plastic or other suitable material. In the illustrated embodiment, the housing 78 includes a base or bottom member 84 and a cover or top member 86. The cover 86 is received on the base 84 and cooperates with the base 84 to define a hollow interior 85 (see FIG. 9) that stores the water reservoir 72.

The base 84 may include a bottom side 88, opposing lateral sides 90, 92, a front 98, and a back 100. The lateral sides 90, 92 define top edges 94, 96 of the base 84. The base 84 includes a mostly open top 102 generally defined between the top edges 94, 96. A small top panel 104 is located at the front 98. The top panel 104 provides a fully enclosed end structure for connecting the housing 78 to a holder 106 that is supported within the opening 80 of the front panel 34. An integrally formed mounting bracket 108 may be provided at the rear 100 of the base 84. The bracket 108 is used to secure the rear portion of the housing 78 to the floor 54 of the machine compartment 50. For example, the bracket 108 may include a flange 110 attached to the floor 54 with fasteners, such as screws. The bracket 108 may be a separate component in other embodiments.

The cover 86 includes a top 114 and sidewalls 116 that extend down from the top. At least some of the sidewalls 116 may define channels 118 that receive the top edges 94, 96 of the base. The cover 86 is received over the open top 102 of the base 84 and cooperates with the base 84 to define the interior 85 of the housing. The cover 86 may include structural ribs 119 on an upper surface 121 of the top 114. The tops of the ribs 119 may project above the upper surface 121. The ribs 119 may increase the rigidity of the cover 86 to resist bending, twisting, and other deformations. The ribs 119 generally extend in the longitudinal direction of the cover 86 in zigzag patterns.

The cover 86 may be secured to the base 84 by retainers 120. In the illustrated example, the retainers 120 are clips. Each of the clips 120 includes a tab 122 mounted on the base 84 and a flexible ring 124 mounted on the cover 86. The ring 124 includes a lower edge that engages with a bottom edge of the tab 122 forming a snap-fit connection. In other embodiments, the retainers 120 may be fasteners, slide members, or any other suitable connection.

Referring back to FIG. 2, the machine compartment 50 may be divided into different zones based on the componentry located within the zone. For example, the machine compartment 50 may include a ventilated zone 150 and a non-ventilated zone 152. A partition 154 divides the machine cabinet into the ventilated zone 150 and the non-ventilated zone 152. The partition 154 includes a wall 156 arranged vertically between the floor 54 and the top panel 26. The wall 156 may include a bottom 158 attached to the floor 54 and a top 161 attached to the top panel 26. The wall 156 also includes a front side 159 and a rear side 162. The wall may be formed of metal, such as stamped aluminum or steel. At least a portion of the ventilated zone 150 is defined between the front panel 34 and the front side 159 of the wall 156 and at least a portion of the non-ventilated zone 152 is defined between the rear side 162 and the rear panel 36.

The ventilated zone 150 may be designed to have lower temperatures than the non-ventilated zone 152. As such, less heat-resistant componentry, such as electronics, e.g., transformer 60, capacitor 62, and circuit board 66, may be located within the ventilated zone 150, whereas more heat-resistant componentry, such as the magnetron 58 and pump system 74, may be located within the non-ventilated zone 152.

Some components of the oven 20 may require placement within both zones 150, 152. One example of this is the water-reservoir assembly 76. The water-reservoir assembly 76 extends rearwardly from the front panel 34, through the ventilated zone 150, and into the non-ventilated zone 152 to connect with the water pump 74. In order to do this, an opening 160 is provided in the wall 156.

Figure 6:
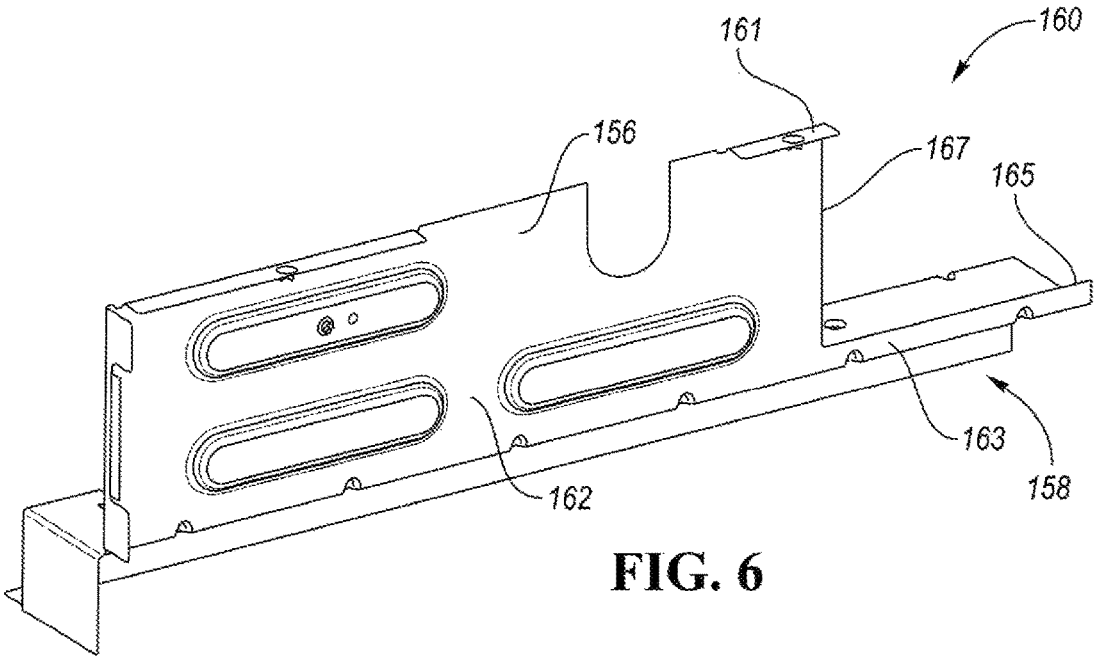
FIG. 6 is a perspective view of a partition wall of the machine compartment.
Figure 7:
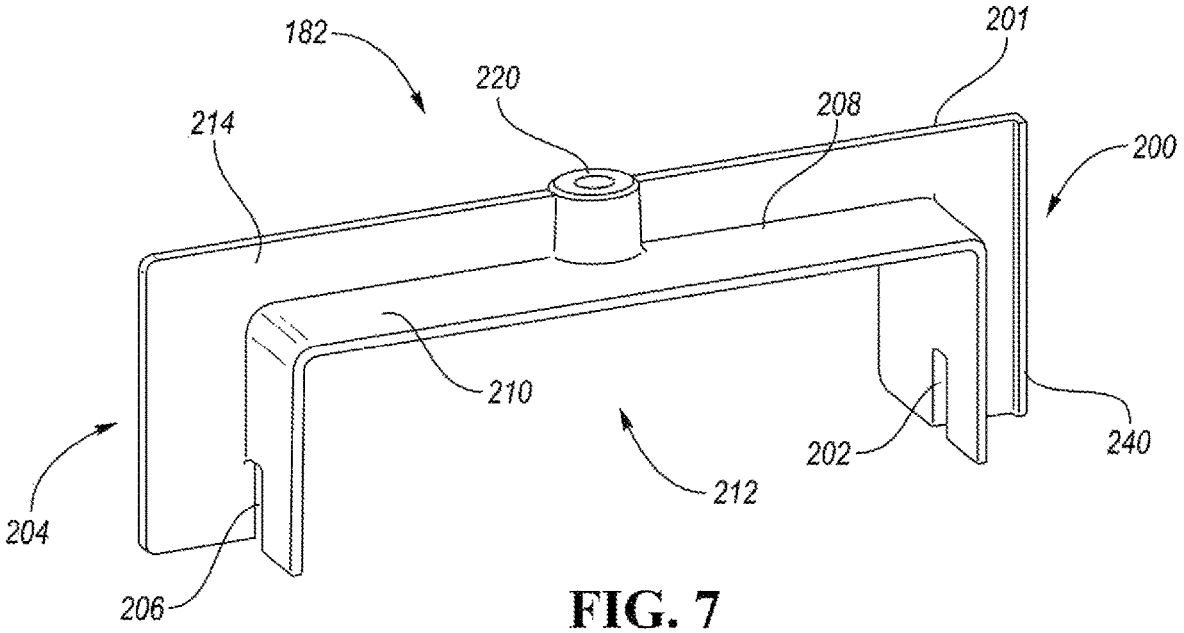
FIG. 7 is a top perspective view of a cap of a flange assembly.

Referring to FIGS. 3, 4, and 6, the opening 160 provides clearance for the housing 78 to extend between the zones 150, 152. The opening 160 may be a rectangular cutout in the wall 156. The opening 160 may be sized and shaped to approximate the cross-section of the housing 78. The opening 160 extends downwardly from a top edge 161 of the wall 156 either partially or fully to the floor 54. For example, the wall 156 may have a lower edge 163 that defines the lower periphery 165 of the opening 160. The opening 160 may be provided at the end of the wall 156 such that the opening 160 is partially defined by the side panel 321. This is just an example and the opening 160 may be located at any suitable location on the wall 156. In the illustrated example, two sides of the opening 160 are defined by the wall 156 (i.e., side periphery 167 and lower periphery 165), another of the sides of the opening 160 is defined by the side panel 32, and a top of the opening 160 is defined by the top panel 26.

While the opening 160 approximates the cross-section of the housing 78, air gaps 171 are still present between the periphery of the opening 160 and the housing 78. The air gaps 171, if unmitigated, would provide clearance for hot air within the non-ventilated zone 152 to leak into the ventilated zone 150. To reduce or eliminate this leakage, a flange assembly 180 is provided at the housing-wall interface to cover the air gaps 171.

The flange assembly 180 circumscribes the housing 78 and is disposed against the wall 156 at the opening 160 to inhibit air flow through the air gaps 171 by covering over the gaps 171. The flange assembly 180 may include a first, upper member 182 and a second, lower member 184. The first and second members 182, 184 are wider than a width of the opening 160. The upper member 182 is received on top of the lower member 184 to form a seal (the seal is not necessarily air-tight) around the housing 78.

The second member 184 may be a flange member that is either attached to or integrally formed with the base 84 of the housing 78. In one embodiment, the flange member 184 is integrally formed with the base 84. The flange member 184 may be a planar body having a front face 188 and rear face 190. The front face 188 is disposed against the rear side or planar surface 162 of the wall 156. The flange member 184 may include a lower portion 192 that extends across the bottom 88 of the housing 78 and opposing side portions 194, 196 that extend partially up the sidewalls 90, 92 of the housing 78.

Referring to FIGS. 4, 7, 8, and 9, the first member 182 may be a cap member that is received on top of the housing 78. The cap member 182 includes a first leg 200 defining a slot 202, a second leg 204 defining another slot 206, and a transverse portion 208 (e.g., a header) extending between the first and second legs to define a C-shaped body 210. The body 210 defines a cavity 212 sized to receive the housing 78. An outer collar 214 projects outwardly from the legs 200, 204 and transverse portion 208. The collar 214 may be planar and oriented to block the air gaps 171.

The cap member 182 is received on a top of the housing 78 with the legs 200, 204 extending over opposing sides 90, 92 of the base 84. The upper edge 201 of the cap member 182 may be substantially coplanar with the top 161 of the wall 156. Used here, substantially means within plus-or-minus 2.0 millimeters of coplanar. The slots 202 and 206 defined in the legs receive upper edges 216 and 218 of the flange member 184 when the cap member 182 is installed. The slots 202 and 206 longitudinally secure the cap member 182. A screw hole 220 is defined in the transverse portion 208 and receives a screw that extends through the top panel 26 to fully secure the cap member 182 in place.

The cap member 182 and the flange member 184 provide a complete encirclement of the opening 160 to cover the air gaps 171. The flange member 184 generally covers the air gaps 171 located on lower portion of the opening 160 and the lower side portions of the opening 160, and the cap member 182 generally covers the upper side air gaps 171 as well as the air gap defined between the top panel 26 and the top of the housing 78.

Figure 8:
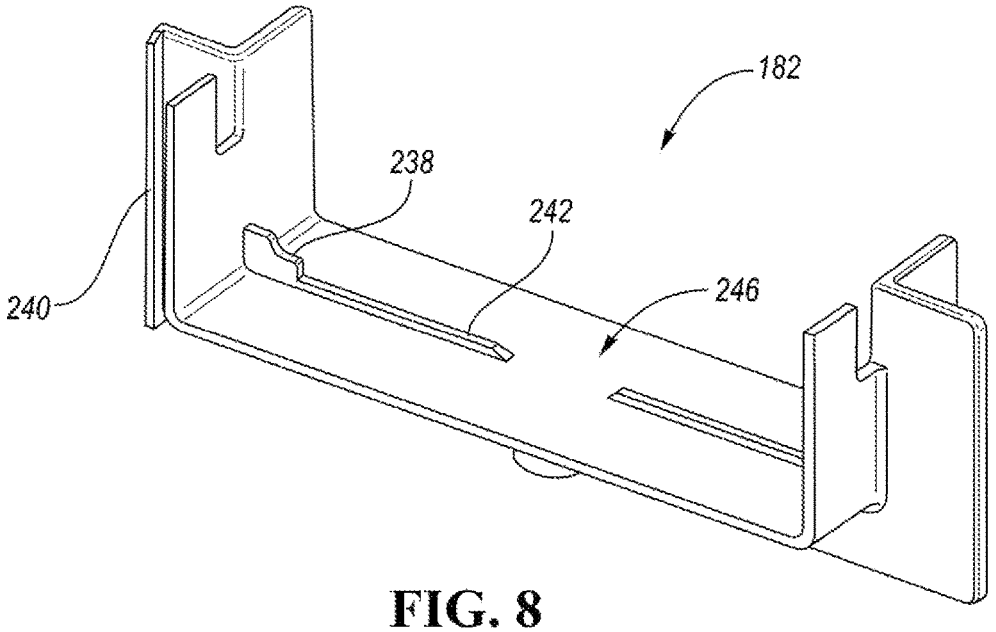
FIG. 8 is a bottom perspective view of the cap.
Figure 9:
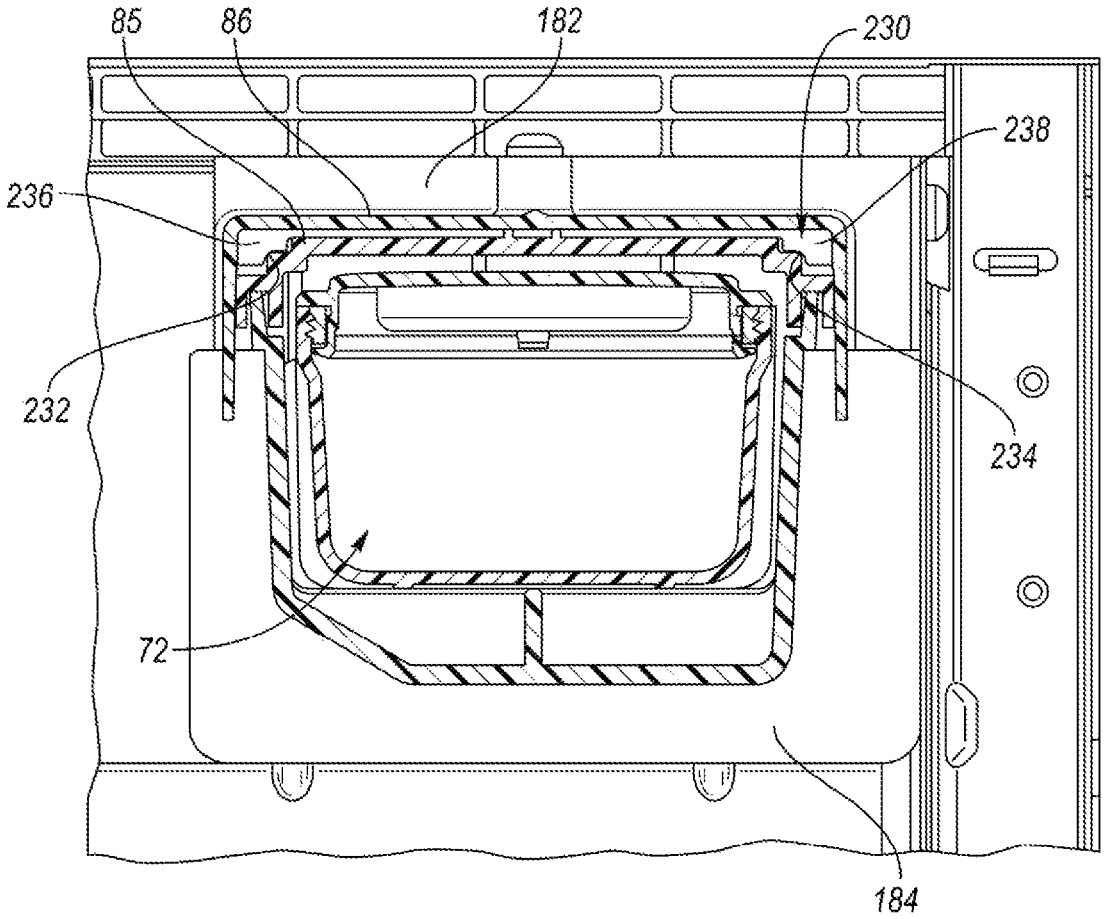
FIG. 9 is a section view of the water-reservoir assembly and machine compartment along cut line 9-9.

Referring to FIGS. 3, 8, and 9, the housing 78 and the cap member 182 may include alignment features 230 for centering the cap member 182 during installation. For example, the cover defines alignment channels 232, 234 on the upper left and right corners. Alignment tabs 236, 238 are provided in the upper left and right corners of the cavity 212. The alignment tabs and channels have cooperating profiles that interlock with each other when the cap member 182 is properly aligned on the housing 78. This is just one example, and other alignment features may be used in other embodiments.

The cap member 182 also includes an alignment feature for aligning with the flange member 184. For example, a hooked portion 240 is provided on the leg 200 at the outer edge of the collar 214. The hooked portion 240 is configured to engage with the outer edge 244 of the flange member 184 to provide lateral centering.

The cap member 182 also includes raised ridges 242 located on the bottom surface of the transverse portion 208. The ridges 242 are provided to account for the space created by the ribs 119 located on the top of the cover 86. The ridges 242 are optional and may not be required depending upon the heat tolerance of the ventilated zone 150. The ridges 242 are spaced apart by a gap 246 that allows the ribs 119 to extend through the cap member 182. The width of the gap 246 is sized to approximate the width between the two ribs at that longitudinal location of the housing 78.

The above-described embodiments allow the water-reservoir assembly to be disposed in multiple zones with limited heat leakage. They embodiments also easy assembly by allowing the water-reservoir assembly to be installed and removed from the top without requiring removal of a side panel or back panel.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to strength, durability, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A cooking appliance comprising:
- a cooking chamber;
- a machine compartment separate from the cooking chamber;
- a wall partitioning the machine compartment into first and second zones;
- a housing disposed in the machine compartment and extending through an opening in the wall such that a first portion of the housing is in the first zone and a second portion of the housing is in the second zone;
- a steam system including a water reservoir disposed in the housing; and
- a flange assembly circumscribing the housing and disposed against the wall at the opening to inhibit air flow though the opening, the flange assembly including a first member and a second member slidably received in the first member.

2. The cooking appliance of claim 1, wherein the second member is integrally formed with the housing.

3. The cooking appliance of claim 1, wherein the second member is a planar member arranged perpendicular to a length of the housing.

4. The cooking appliance of claim 1, wherein the first member defines a slot and the second member has an edge portion received in the slot.

5. The cooking appliance of claim 1, wherein the first member is a cap member having a first leg defining a slot and a second leg defining another slot, and the second member is a planar member, wherein the first and second legs are disposed on opposite sides of the housing and each receives an edge portion of the planar member.

6. The cooking appliance of claim 1, wherein the first member includes a hooked portion that engages with an edge of the second member.

7. The cooking appliance of claim 1, wherein a width of the opening is less than widths of the first and second members.

8. The cooking appliance of claim 1, wherein the housing defines an alignment channel, and the first member defines an alignment tab cooperating with the alignment channel to align the first member relative to the housing.

9. The cooking appliance of claim 1, further comprising a magnetron disposed in the machine compartment.

10. The cooking appliance of claim 1, wherein the housing includes a base and a cover received on the base, wherein the second member is associated with the base and the first member is disposed over the cover.

11. The cooking appliance of claim 10, wherein the second member is integrally formed with the base.

12. A cooking appliance comprising:
- a cooking chamber;
- a machine compartment separate from the cooking chamber;
- a wall partitioning the machine compartment into a ventilated zone and a non-ventilated zone, wherein the wall defines an opening;
- a housing disposed in the machine compartment and extending through the opening such that a first portion of the housing is in the ventilated zone and a second portion of the housing is in the non-ventilated zone, wherein a gap is defined between the housing and a periphery of the opening;
- a steam system including a water reservoir disposed in the housing, wherein the steam system is configured to deliver steam to the cooking chamber; and
- a flange assembly circumscribing the housing and disposed against the wall such that the gap is covered to inhibit airflow between the zones, the flange assembly including a flange member surrounding a portion of the housing and a cap member surrounding another portion of the housing.

13. The cooking appliance of claim 12, wherein the cap member defines a slot that receives a portion of the flange member to attach the flange member and the cap member together.

14. The cooking appliance of claim 12 further comprising:
- a circuit board disposed in the ventilated zone; and
- a microwave system including a magnetron, the magnetron being disposed in the non-ventilated zone, wherein the microwave system is configured to deliver microwave energy to the cooking chamber.

15. The cooking appliance of claim 14, wherein the housing includes a base and a cover received on the base, wherein the flange member is integrally formed with the base and includes a planar surface that is disposed against a planar surface of the wall, wherein the cap member includes a first leg defining a slot, a second leg defining another slot, and a planar portion extending between the first and second legs to define a C-shaped body, wherein body is received on a top surface of the housing with the legs extending over opposing sides of the base such that each of the slots receives an upper edge of the flange member.

16. The cooking appliance of claim 12, wherein the wall includes an upper edge and a lower edge, wherein the housing includes a bottom side that is above the lower edge and a top side that is below the top edge, and wherein the flange member covers a first portion of the gap defined between the lower edge of the wall and the bottom side of the housing, and the cap member is disposed on the top side of the housing and has an upper edge that is substantially coplanar with the upper edge of the wall.

17. A cooking appliance comprising:

a front panel defining an opening into a cooking chamber;

a top panel;

a machine compartment disposed above the cooking chamber and under the top panel, the machine compartment including a wall positioned reward of the front panel and extending between the top panel and a floor of the machine compartment, wherein the machine compartment includes a ventilated zone between the front panel and the wall and a non-ventilated zone rearward of the wall;

a water-reservoir assembly disposed in the machine compartment and including a housing extending rearward from the front panel and through a wall opening defined in the wall such that the housing is partially disposed in both the ventilated and non-ventilated zones, the housing including a base and a cover, wherein the base defines a flange configured to cover a gap defined between the base and a periphery of the wall opening; and a cap member disposed on the cover at the wall opening and including a planar portion extending between the top panel and the cover to inhibit air flow through the wall opening.

18. The cooking appliance of claim 17, wherein the cap member further includes a pair of legs depending from the planar portion and disposed on opposite sides of the base, wherein each of the legs defines a slot that receives upper portions of the flange.

19. The cooking appliance of claim 17, wherein the cover defines an alignment channel, and the cap member defines an alignment tab received in the alignment channel.

* * * * *